US005603123A

United States Patent [19]

Chupa

[11] Patent Number: 5,603,123

[45] Date of Patent: Feb. 18, 1997

[54] INVALID GARMENT AND METHOD FOR MAKING THE SAME

[76] Inventor: Barbara A. Chupa, 36743 Winterset, Clinton Township, Macomb County, Mich. 48035

[21] Appl. No.: 452,144

[22] Filed: May 26, 1995

[51] Int. Cl.[6] ..... A41D 10/00; A41D 27/00; A41D 27/24; A41B 1/08

[52] U.S. Cl. ..... 2/275; 2/114; 2/912; 2/913; 2/914

[58] Field of Search ..... 2/2.15, 2, 1, 104, 2/105, 106, 113, 114, 115, 266, 274, 275, 912, 913, 914, 915

[56] References Cited

U.S. PATENT DOCUMENTS

| | | | |
|---|---|---|---|
| 676,158 | 6/1901 | St. John | 2/114 |
| 1,534,174 | 4/1925 | Frank | 2/115 |
| 4,293,957 | 10/1981 | Melarvie | 2/275 X |
| 4,651,353 | 3/1987 | Walden | 2/114 |
| 4,939,794 | 7/1990 | Aronson | 2/60 |
| 4,964,173 | 10/1990 | Gordon et al. | 2/114 |
| 5,097,535 | 3/1992 | Dye et al. | 2/114 X |
| 5,359,731 | 11/1994 | Cavalier | 2/79 X |

OTHER PUBLICATIONS

Guide to Independent Living for People with Arthritis, 1988, pp. 1–2, 61–73.

*Primary Examiner*—Jeanette E. Chapman
*Attorney, Agent, or Firm*—Young & Basile, P.C.

[57] ABSTRACT

An invalid garment 10 having at least one seam 12–18. The seam 12–18 includes mating attaching members 36, 38 which are adapted to selectively close and open the seam. A method of making garment 10 is also disclosed and includes the steps of opening a closed seam and inserting members 36, 38 into the seam.

13 Claims, 4 Drawing Sheets

INVALID GARMENT AND METHOD FOR MAKING THE SAME

FIELD OF THE INVENTION

This invention relates to invalid garments and a method for making the same and, more particularly, to a garment having means disposed in the seam for allowing a portion of the garment to become separated or removed and subsequently and selectively re-secured.

BACKGROUND OF THE INVENTION

Many people have limb and other sorts of dysfunctionalities which restrict the mobility of limbs, such as arms, legs, or the neck, and which make it very painful to fully extend or use such limbs. Examples of such dysfunctionalities include severe arthritis which attacks such joints as the knees or elbows and which makes it impossible or painfully difficult to respectively and fully extend or use the arm and leg. Moreover, some of these dysfunctionalities may only be temporary and may be caused by surgery. For example, an individual undergoing physical therapy after extensive and perhaps reconstructive shoulder surgery may find it temporarily difficult and painful to fully use one or more shoulders and arms.

Many individuals suffering from these dysfunctionalities have difficulty in "putting on clothes" such as pants, shirts, or various other articles and have further difficulties in removing such clothing from their body. These difficulties are primarily due to the difficulty in extending their dysfunctional limbs in the manner necessary to put on or to remove such clothing. This difficulty necessitates the need for personal assistance in this activity. Such assistance is both costly and undesirable to many people as it is frequently regarded as an invasion of privacy and as unwanted dependence.

There is therefore a need for a garment or article of clothing which is adapted to be selectively and easily removed or applied by and to an individual having the aforedescribed dysfunctionalities. There is also a need for a method of manufacturing such a garment, effective to allow such garments to be easily made at a minimum of cost.

SUMMARY OF THE INVENTION

It is desirable in the present invention to provide a garment or article of clothing, such as a hospital gown, which may be easily applied and removed from an individual. It is further desirable to provide a method of manufacture of such a garment, effective to allow the garment to be easily manufactured. According to the teachings of the present invention, a garment is provided having at least one seam extending along an entire length of the garment. Attaching means is disposed in the seam for removably and selectively allowing the seam to be split.

According to the teachings of the present invention, a method of manufacturing an invalid garment is provided including obtaining a garment having at least one seam; splitting the seam extending along an entire length of the garment; placing a first attaching member on a first portion of said article along one side of said split seam; and placing a second attaching member on a second portion of said article along a second side of said split seam, the second attaching member being adapted to removably mate with the first attaching member in a manner which will selectively allow the garment seam to be removably secured.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
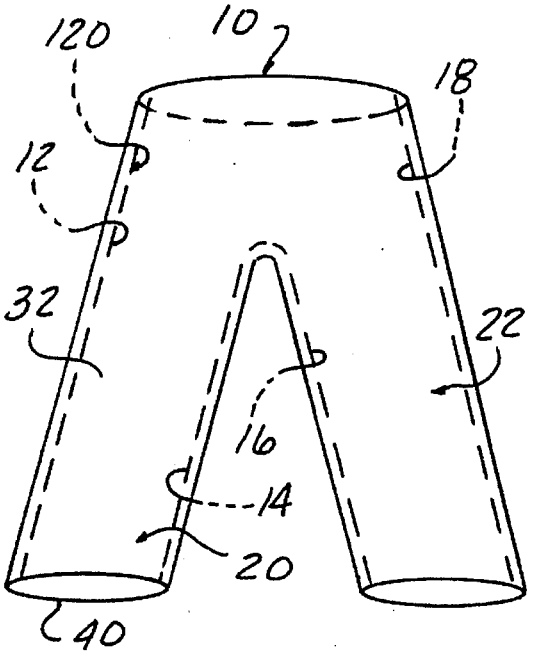
FIG. 1 is a partial perspective view of conventional trousers or pants.

Referring now to FIG. 1, there is shown an article of clothing or a garment 10 which represents a conventional pair of trousers or pants. It should be appreciated by one of ordinary skill in the art that although the following discussion of the invention relates to trousers 10, other types of clothing (e.g. shirts, dresses, bathrobes, hospital garments or gowns, or any other article having at least one seam extending along an entire length of the garment) may be used and to which the principals of this invention may be applied.

As shown, trousers 10 include four seams 12, 14, 16, and 18 which are normally stitched or sewn together and which traverse the length of the trousers. The application of these trousers (e.g. "putting them on" the body) requires a substantial amount of leg dexterity as each of the legs must be sequentially raised and "fitted" into each of the long hollow portions 20, 22 of the trouser 10. Substantially the same type of dexterity is required to remove the article of clothing from the body.

Figure 3:
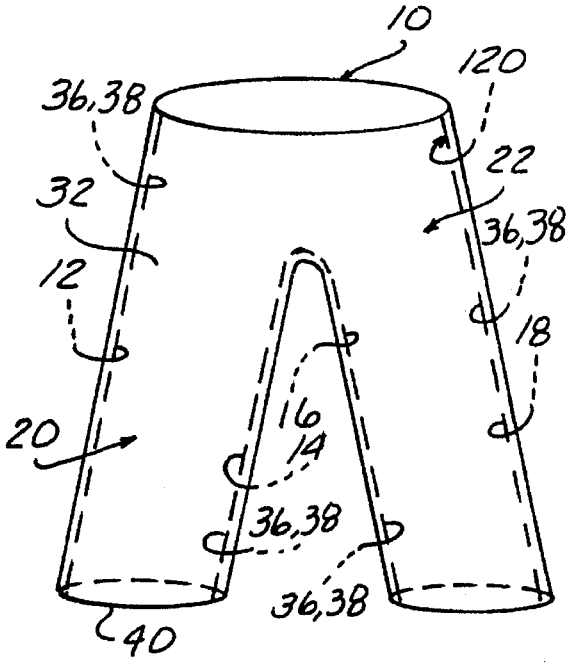
FIG. 3 is a partial perspective view of the trousers in FIG. 1 incorporating the features of the present invention.
Figure 2:
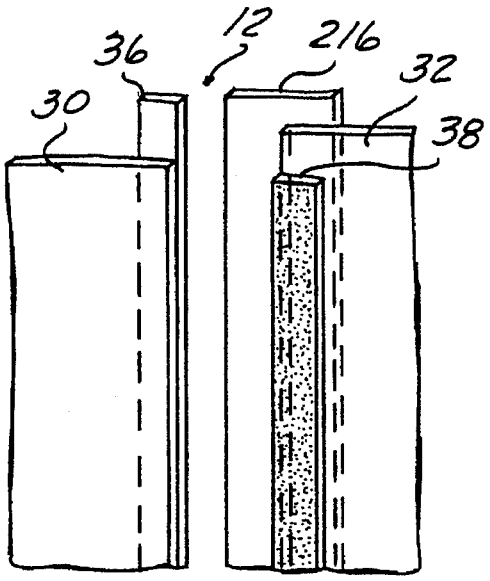
FIG. 2 is a detailed exploded perspective view illustrating attaching members along a seam of a garment according to the present invention.

In order to allow a person having some sort of leg dysfunctionality to easily apply and remove the trousers 10, the invention modifies the conventional trousers. By use of this method, an invalid garment may be created which is relatively easily removable from the body. Specifically, as shown in FIG. 2, at least seam 12 is split, and preferably seam 18 as well (as are the other seams 14, 16 could be split if desired), by cutting and removing the thread or other conventional seam securing means from the entire length of the seam, thereby allowing the portion of the garment 30, 32 which was previously joined by seam 12 and the other seam 18 to be separated. The thread or other conventional seam securing means is replaced with removably attaching or "mating" members. For example, material portion 30 is made to have at least one commercially available male snap, or hook material portion 36, and portion 32 is made to have at least one commercially available female snap, or loop material portion 38. As shown in FIG. 1, portions 30 and 32 are on opposing sides of seam 12. Snaps, or hook and loop material portions 36 and 38, in the preferred embodiment of the invention, are made to be in a confrontational relationship and placed on corresponding positions of respective portions 30, 32, each equidistant from bottom portion 40. When snaps, or hook and loop material portions 36 and 38 are joined, as best shown in FIG. 3, the seam is closed and appears normal. When the snaps, or hook and loop material portions 36 and 38 are opened, the seam is also opened. According to the teachings of the present invention, each of the seams 12 and 18 (and optionally 14 and 16) is split in the previously described manner and pairs of snaps or hook and loop material portions 36, 38 are placed in each of the seams as described above. 0f course it is within the scope of the present invention to optionally modify seams 14 and 16 of the conventional trousers as well to provide a garment that is also easily applied and removed from an individual. In its simplest form, the present invention provides at least one seam, preferably extending along an entire longitudinal length of the garment, with closure means for selectively opening and closing the seam. Preferably, the closure means is of a press-together-to-secure type, such as hook and loop material commercially available under the tradename VELCRO™, preferably extending along the entire longitudinal length of the seam.

When it is desired to apply or remove trousers 10, all of the snaps, or hook and loop material portions 36, 38 are moved to the open position (shown in FIG. 2).In this manner, the dysfunctional person simply "wraps the trousers around his or her legs", thereby obviating the need for manual "gymnastics" in which the legs are fitted into the trousers. After the garment is wrapped around the legs, the snaps, or hook and loop material portions are moved to the closed position, shown in FIG. 3. In the closed position, the trousers may be normally worn. It should also be apparent that snaps, or hook and loop material portions 36, 38 cooperatively allow the seam 12 to be selectively opened and closed. It should also be apparent to one of ordinary skill in the art that while the preferred embodiment of the invention provides for the disposing of members 36, 38 into a preexisting seam, other methodologies are available and contemplated to be covered by this invention. For example, a garment 10 may be cut in a manner to form a new seam for an old garment, or cut from a pattern to make a new seam for a new garment. Such cuts 120 may be made in any desirable location on the garment and members 36, 38 may be disposed in this new seam.

It should be appreciated that any number of snaps or securing members may be used or placed within the seams 12–18 and that the securing members may comprise snaps, or mating hook and loop material, such as VELCRO™ type members. In the preferred embodiment of this invention, the VELCRO™ members, or other suitable type of hook and loop mating material capable of press on attachment, traverses the entire length of each of the seams.

Figure 4:
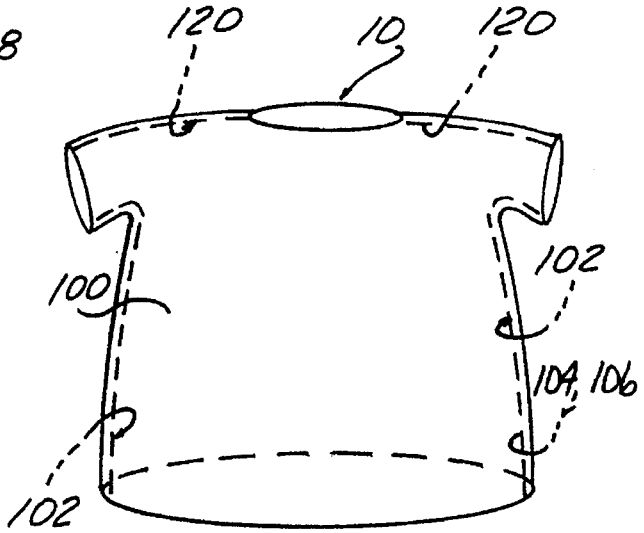
FIG. 4 is a partial perspective view of a conventional hospital gown incorporating the present invention.

As shown in FIG. 4, this invention may also be applied to a hospital gown 100 having a seam 102 to which snaps or VELCRO™ members 104, 106 are deployed in substantially the same manner shown above. The modified hospital gown allows a patient to quickly and easily place the gown on the body or remove it.

Cuts 120 may optionally be made along the upper portion of the garment 10 for the incorporation of additional closure means, such as hook and loop material members 36, 38 along each cut 120 between the neck opening and the arm opening for selectively opening and closing that portion of the garment.

Figure 6:
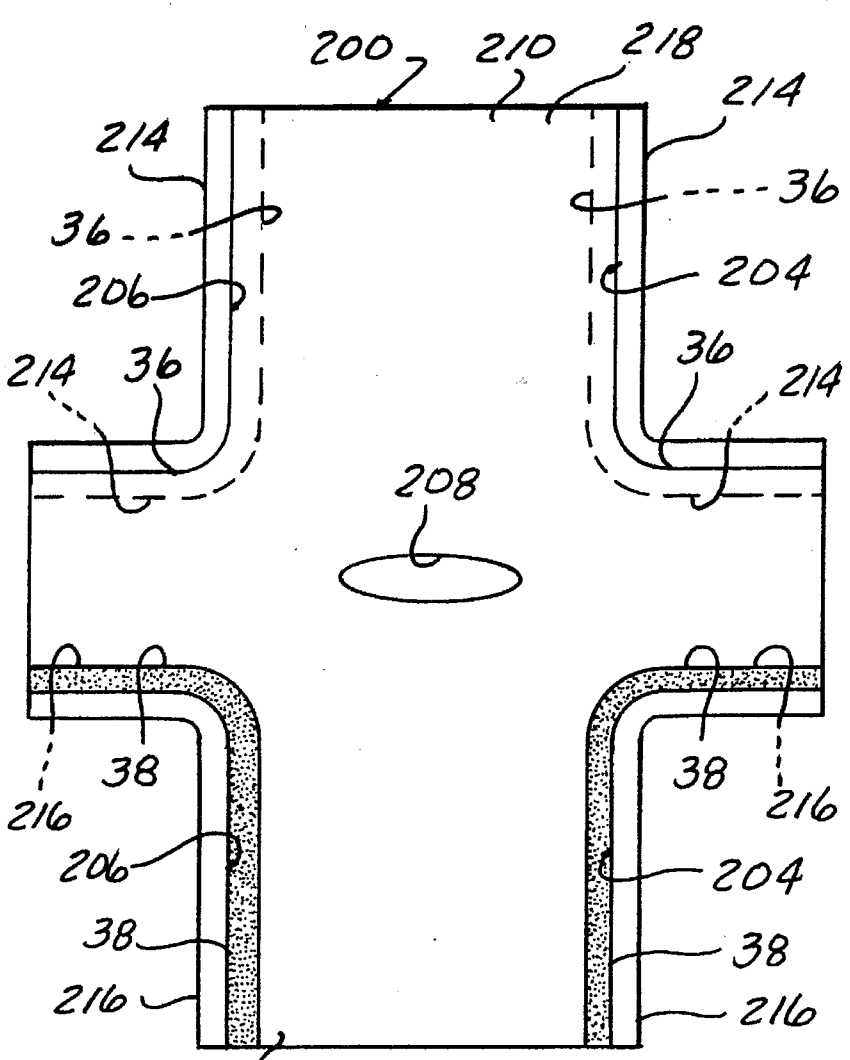
FIG. 6 is a plan view of the outside surface of the shirt lying flat with seams under the arm openings in the open position.
Figure 5:
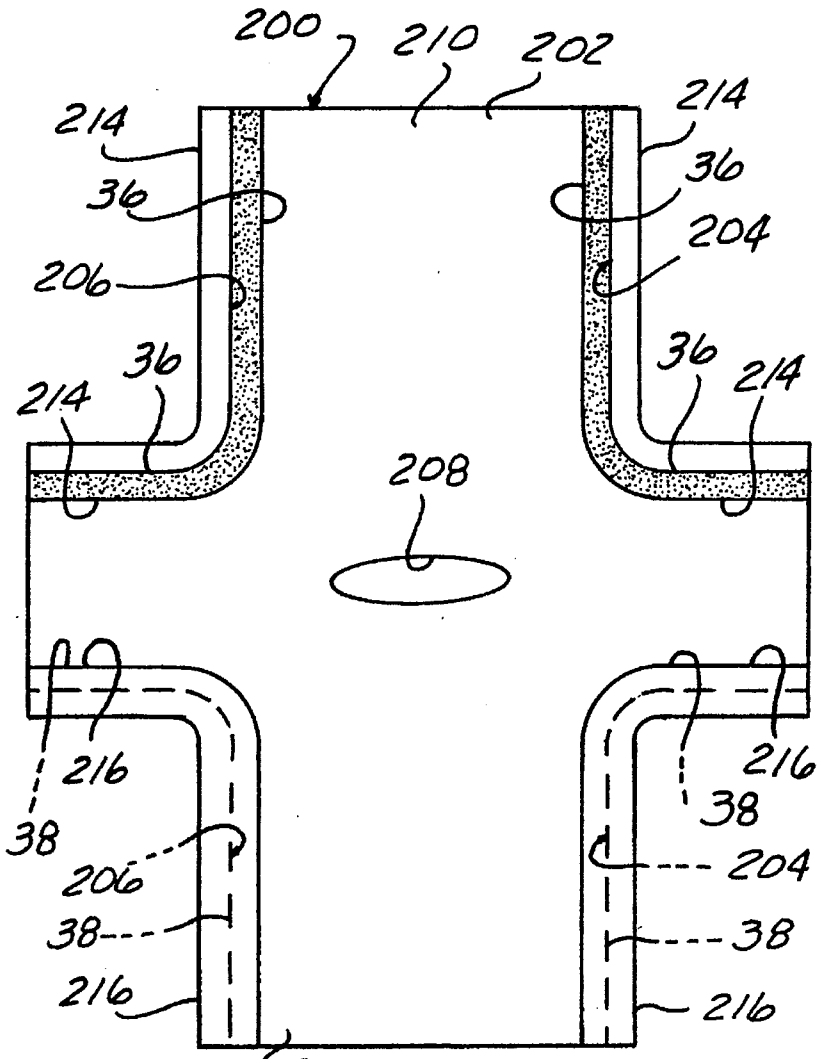
FIG. 5 is a plan view of the inside surface of a shirt lying flat with seams extending under the arm openings in an open position.
Figure 7:
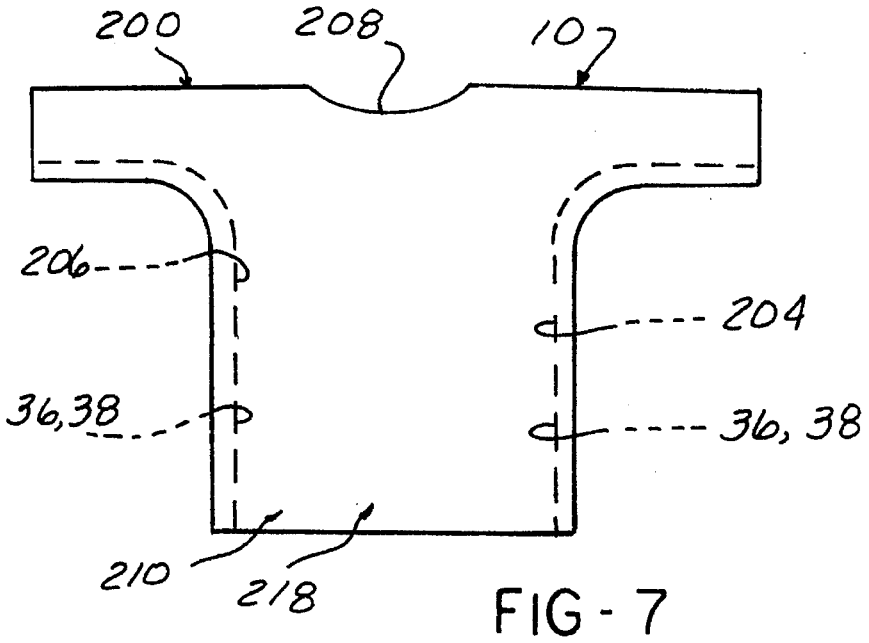
FIG. 7 is a plan view of the shirt with the underarm seams in the closed position.

Referring now to FIGS. 5, 6 and 7, a shirt 200 according to the present invention is illustrated. In FIG. 5, the inside surface 202 is shown in plan view with the underarm seams 204 and 206 in an open position. The aperture 208 for passage of head and neck can be seen in the central portion of FIG. 5. The front portion 210 of the inside surface 202 of the shirt is shown above the rear portion 212 of the inside surface 202 of the shirt 200. The front portion 210 of the shirt 200 preferably includes a strip of material or binding 214 connected along the whole length of the seams 204 and 206, on at least one of the inside surface and the outside surface, in an overlapping relationship with the front portion 210 of the shirt 200. Optionally, the extra strip of material or binding 214 overlap the front portion 210 of the shirt with an overall width of approximately ½ inch to 1 inch. When the width is greater than ½ inch, the strip of extra material 214 may extend outwardly beyond the seam, 204 or 206, of the shirt 200 by up to approximately ¾ inch. One portion 36 of the closure means is disposed along the front portion 210 of the inside surface 202 of the shirt 200, either the hook material portion or the loop material portion of the closure means. The portion 36 connected to the front portion 210 of the inside surface 202 can be attached on top of the extra strip of material or binding 214 inside the respective seams 204 and 206. An extra strip of material or binding 216 is connected to the rear portion 212 of the inside surface 202 of the shirt 200. The extra strips of material 214, 216 are connected to the shirt 200 by any suitable means, such as sewing or the like. The extra strip of material or binding 216 may overlap the rear portion 212 of the shirt with an overall width of approximately ½ inch to 1 ¼ inch. When the width is greater than ½ inch, the strip of extra material 216 may extend outwardly beyond the seam, 204 or 206, of the shirt 200 by up to approximately ¾ inch. The bottom inside seam of the garment overlaps the closure means to protect the wearer's skin from irritation.

Referring now to FIG. 6, the outside surface 218 of the shirt 200 is shown. The front portion 210 is illustrated above the rear or back portion 212 as illustrated in FIG. 6. A portion of the strip of material 214 is visible extending outwardly beyond the seams 204 and 206 while the portion 36 of the closure means is hidden beneath the front portion 210 of the shirt 200. The other portion 38 of the closure means, either the hook material portion or the loop material portion corresponding to the mating part of 36, is connected along the respective seams 204 and 206 of the rear portion 212 of the outside surface 218 of the shirt 200. A portion of the extra strip of material or binding 216 extending beyond the seams 204 and 206 and beyond the edge of the connector portion 38 is visible. The closure means 38 is approximately ½ inch in width and is sewn directly onto the outside surface 218 of the rear portion 212 of the shirt 200 along the entire length of the underarm seams 204 and 206. The closure means 38 extends inwardly from the edge portion of the seams 204 and 206.

Referring now to FIG. 7, the shirt 200 according to the present invention is shown with the underarm seams 204 and 206 in the closed position. The closed position corresponds to attaching mating portions 36, 38 of the closure means to one another in face to face engagement. The extra strips of material 214 and/or 216, if one or both are greater in overall width than ½ inch, may extend outwardly to cover and protect the wearer's skin from contact with the closure means, and/or to provide a pleasant external appearance. The function of the extra strip 216 positioned on the inside surface 202 of the shirt 200 or any other garment, is to provide protection from contact of the closure means with the skin of the person wearing the garment 10. This is particularly important with respect to individuals who are bedridden, and are subject to bedsores and other skin ailments that may be caused, irritated or aggravated by prolonged contact with the closure members. The extra strips of material or bindings 214 and 216 are selected to be of any suitable material, preferably a soft washable material, such as silk, satin, velvet, or the like is used. It should be recognized that the material selected for the extra strips or bindings 214 and 216 could be the same material as used in the garment, particularly for the external strip of material 214 which is optionally provided to enhance the external appearance of the article by hiding the closure means from view. The bindings 214 and 216 may be disposed on the inside surface 202, or the outside surface 218, or both the inside and the outside surfaces 202, 218 of the shirt 200 or any other seam of a garment. Preferably, in the closed position, the closure means is not visible from the outside in the front or the back, because all connections occur on the inside of the seams of the garment 10. The extra strip of material or binding 216 on the internal portion of the garment prevents scratching and irritation from the closure means, and is hidden to provide a normal looking garment when worn by the user. The closure portion 36 on the inside surface 202 of the front portion 210 of the shirt 200 connects to the closure portion 38 on the outside surface 218 of the rear portion 212 of the shirt 200. The extra strip of material 216 is folded or curled in to connect to 36 so that no closure means is visible. While worn, the garment 10, such as the shirt 20 appears as a normal shirt with normal sleeves. The same can be accomplished with pants, hospital gowns, coats, dresses, T-shirts, or any other garment desired.

Figure 8:
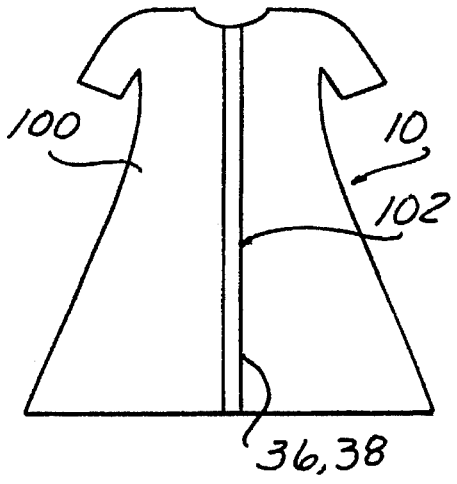
FIG. 8 is a plan view of a hospital gown with a seam cut along an entire length of the garment in the front for closure means according to the present invention.

Referring to FIG. 8, a garment 10, such as a hospital gown 100 is illustrated according to the present invention. Preferably, the hospital gown 100 is originally fabricated with no seam, or a closed seam in the back, while a seam 102 is originally provided, or if not originally provided formed in the front of the hospital gown 100. The seam 102 can be selectively closed and opened by the user when provided with longitudinally extending portions 36, 38 of the closure means according to the present invention. The closure in the front of the hospital gown 100 being preferred by the large majority of patients visiting a health care facility. If desired by the medical profession, a seam according to the present invention can also be provided in the back of the hospital gown.

Figure 9:
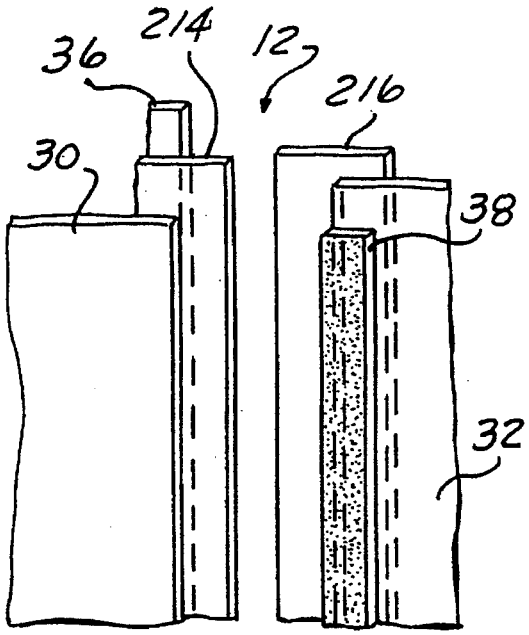
FIG. 9 is a detailed exploded perspective view of a seam arrangement according to the present invention.
Figure 10:
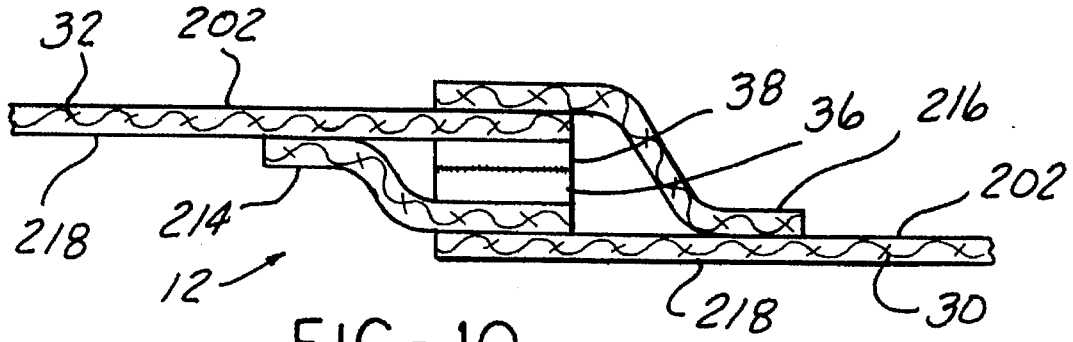
FIG. 10 is a cross-sectional view of the seam in FIG. 9 according to the present invention.
Figure 11:
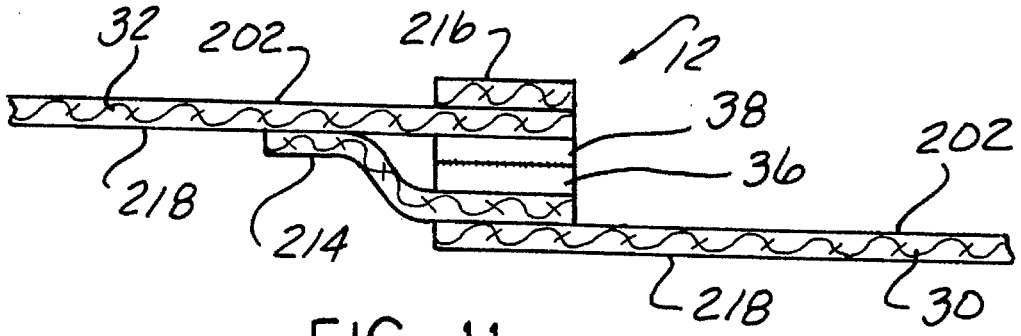
FIG. 11 is a cross-sectional view of a seam according to the present invention.
Figure 12:
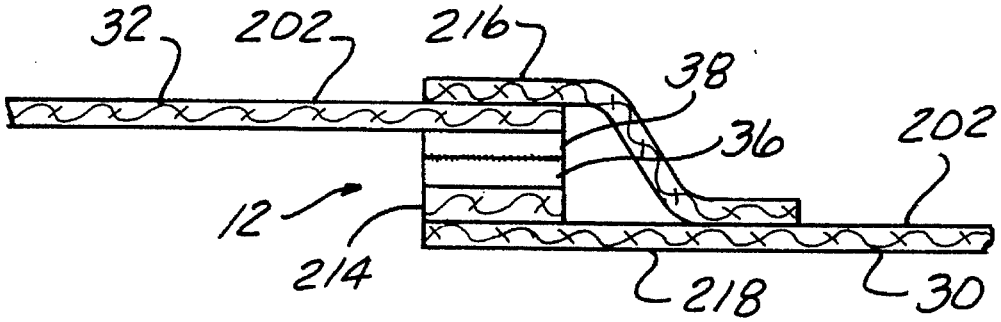
FIG. 12 is a cross-sectional view of the seam in FIG. 2 according to the present invention.
Figure 13:
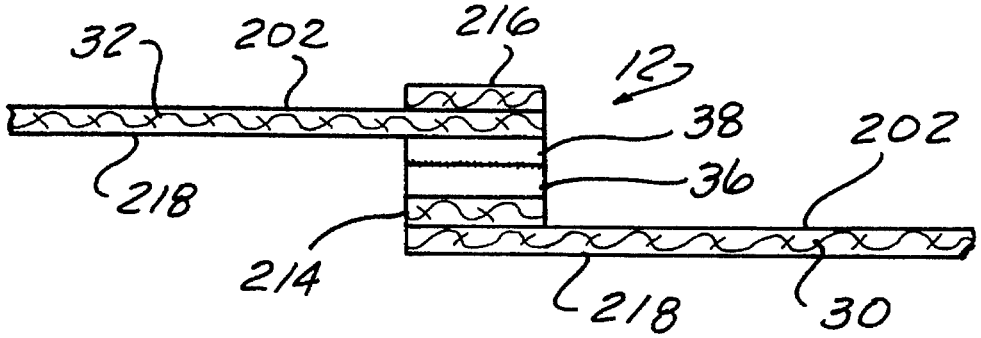
FIG. 13 is a cross-sectional view of a seam according to the present invention.

Referring now to FIGS. 2, 9 through 13, the preferred and alternative embodiments of a seam according to the present invention are illustrated in exploded perspectives and a cross-sectional views. Referring first to FIG. 2, the present invention illustrates a seam 12 which includes closure means for selectively opening and closing the seam along its entire longitudinal length. One portion of the garment 30 includes a first portion 36 of the closure means while the second portion 38 of the closure means is connected to another portion 32 of the garment. A strip of extra material or binding 216 is connected to the inside surface of the garment to protect the person wearing the garment from undesirable irritation and scratching from the closure means. In FIGS. 2, 9, 10 and 12 the binding 216 is shown having an overall width greater than approximately ½ inch, while binding 216 is shown in FIGS. 11 and 13 having an overall width no greater than approximately ½ inch. The ½ inch dimension corresponding generally to the overall width of the hook and loop material portions of the closure means.

Referring now to FIGS. 9 and 10, an optional strip of material or binding 214 can be added between the portion 30 of the garment and the first portion 36 of the closure means to assist in hiding the closure means from view externally of the garment while being worn. Referring now to FIG. 10, a cross-sectional view of the seam 12 illustrated in FIG. 9 is shown. The optional extra strip of material 214 is shown for illustration purposes. As can be seen in FIG. 10, the first and second portions, 36 and 38 of the closure means are pressed together in face to face engagement in order to connect and selectively close the seam 12 of the garment 10. The strip of material 216 on the inner surface of the garment 10 protects the wearer against irritation and scratching from the closure means. The optional strip of material 214 can be provided to obstruct any view of the closure means from the exterior of the garment. FIG. 11 illustrates a seam according to the present invention with a binding 216 no greater in overall width of the portions of the closure means and a binding 214 having an overall width greater than the overall width of the closure means portions 36, 38. FIG. 12 shows a seam according to the present invention width a binding 216 having an overall width greater than an overall width of the closure means 36, 38 and a binding 214 having an overall width no greater than the width of the closure means. FIG. 13 depicts a seam according to the present invention with a binding 216 and a binding 214 both having an overall width no greater than an overall width of the closure means 36, 38. The seam 12 could also be made without bindings 214 and/or 216 if the material is sufficiently strong to support the closure means without the binding, and without exhibiting undesirable curing of the closure means 36, 38 after repeated washings and if the material or manner of fastening the closure means to the garment is sufficiently non-irritating to the person wearing the garment.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A garment comprising:

at least one seam defined by first and second overlapping portions of material extending along an entire longitudinal length of the garment;

attaching means, disposed in said at least one seam, for selectively closing and opening said at least one seam, said attaching means extending along said entire longitudinal length of said at least one seam, wherein said attaching means includes hook and loop material connected to opposing surfaces of said at least one seam for selectively closing said seam by pressing opposing surfaces of said hook and loop material to one another;

first material strip means connected to said at least one seam for protecting a wearer of the garment against abrasion and scratching due to contact between skin and said attaching means, said first material strip means extending substantially along the entire longitudinal length of the garment and extending transversely beyond a longitudinally extending edge of said seam to overlay interposed between said wearer and said attaching means when said seam is in a closed position, said first material strip means including a first strip of material connected to said at least one seam for protecting a wearer of the garment against abrasion and scratching due to contact between skin and the attaching means, the first strip of material connected to said first portion of material extending substantially along the entire longitudinal length of the seam and the first strip of material further extending laterally beyond the longitudinally extending edge of said first portion of material defining the seam to overlap laterally with respect to said second portion of material defining the seam thereby protecting the wearer from contact with said attaching means by transversely overlapping the seam; and a second strip of material connected to said at least one seam for hiding said attaching means from view externally of the garment, the second strip of material connected to said second portion of material extending substantially along the entire longitudinal length of the seam and further extending laterally beyond a longitudinally extending edge of the second portion of material defining the seam to overlap the first portion of material defining the seam thereby hiding said attaching means from view externally of the garment.

2. The garment of claim 1 further comprising:

said first material strip means connected to an inside surface of said at least one seam.

3. The garment of claim 1 further comprising:

second material strip means connected to said at least one seam opposite from said first material strip means with said attaching means interposed between said first and second material strip means.

4. The garment of claim 3 further comprising:

said second material strip means for hiding said attaching means from view externally of the garment.

5. The garment of claim 1 further comprising:

second material strip means connected to said at least one seam for hiding said attaching means from view externally of the garment.

6. The garment of claim 5 further comprising:

the second material strip means connected to an outside surface of said at least one seam.

7. The garment of claim 1 further comprising:

said attaching means extending along said entire longitudinal length of said at least one seam.

8. The garment of claim 1 manufactured by a method comprising the steps of:

forming at least one seam in said garment;

inserting attaching means within said at least one seam for selectively opening and closing said at least one seam; and connecting first material strip means to said at least one seam for protecting a wearer of the garment against abrasion and scratching due to contact between skin and said attaching means, said first material strip means extending substantially along the entire longitudinal length of the garment and extending transversely beyond a longitudinally extending edge of said seam to overlay interposed between said wearer and said attaching means when said seam is in the closed position.

9. A method of making a garment comprising the steps of:

providing a garment having at least one seam defined by first and second portions of overlapping material;

splitting said at least one seam;

inserting attaching means within said at least one seam for selectively opening and closing said at least one seam; and connecting first material strip means to said at least one seam for protecting a wearer of the garment against abrasion and scratching due to contact between skin and said attaching means, said first material strip means extending substantially along the entire longitudinal length of the garment and extending transversely beyond a longitudinally extending edge of said seam to overlay interposed between said wearer and said attaching means when said seam is in a closed position, said connecting step further including the step of inserting a first strip of material connected to the first portion of material defining said at least one seam for protecting a wearer of the garment against abrasion and scratching due to contact between skin and the attaching means, said first strip of material extending laterally beyond a longitudinally extending edge of said first portion of material to overlap said second portion of material when said seam is in the closed position, and inserting a second strip of material connected to said second portion of material defining said at least one seam for hiding said attaching means from view externally of the garment, said second strip of material extending laterally beyond a longitudinally extending edge of said second portion of material to overlap said first portion of material when said seam is in the closed position, said attaching means interposed between said first and second strips of material when said seam is closed.

10. The method of claim 9 further comprising the step of:

inserting second material strip means connected to said at least one seam for hiding said attaching means from view externally of the garment.

11. A method of making a garment comprising the steps of:

forming at least one seam defined by first and second overlapping portions of material in the garment;

inserting attaching means within said formed seam for selectively opening and closing said seam; and connecting first material strip means to said at least one seam for protecting a wearer of the garment against abrasion and scratching due to contact between skin and said attaching means, said first material strip means extending substantially along the entire longitudinal length of the garment and extending transversely beyond a longitudinally extending edge of said seam to overlay interposed between said wearer and said attaching means when said seam is in a closed position, said connecting step including the step of inserting a first strip of material connected to the first portion of material defining said at least one seam for protecting a wearer of the garment against abrasion and scratching due to contact between skin and the attaching means, said first strip of material extending laterally beyond a longitudinally extending edge of said first portion of material to overlap said second portion of material when said seam is in the closed position, and inserting a second strip of material connected to said second portion of material defining said at least one seam for hiding said attaching means from view externally of the garment, said second strip of material extending laterally beyond a longitudinally extending edge of said second portion of material to overlap said first portion of material when said seam is in the closed position,. said attaching means interposed between said first and second strips of material when said seam is closed.

12. The method of claim 11 further comprising the step of:

inserting second material strip means connected to said at least one seam for hiding said attaching means from view externally of the garment.

13. A garment manufactured by the method of claim 11 comprising:

at least one seam defined by first and second overlapping portions of material extending along an entire longitudinal length of the garment;

attaching means, disposed in said at least one seam, for selectively closing and opening said at least one seam; and first material strip means connected to said at least one seam for protecting a wearer of the garment against abrasion and scratching due to contact between skin and said attaching means, said first material strip means extending substantially along the entire longitudinal length of the garment and extending transversely beyond a longitudinally extending edge of said seam to overlay interposed between said wearer and said attaching means when said seam is in a closed position.

* * * * *